US006260017B1

(12) United States Patent
Das et al.

(10) Patent No.: US 6,260,017 B1
(45) Date of Patent: Jul. 10, 2001

(54) MULTIPULSE INTERPOLATIVE CODING OF TRANSITION SPEECH FRAMES

(75) Inventors: Amitava Das; Sharath Manjunath, both of San Diego, CA (US)

(73) Assignee: Qualcomm Inc., San Diego, CA (US)

( * ) Notice: Subject to any disclaimer, the term of this patent is extended or adjusted under 35 U.S.C. 154(b) by 0 days.

(21) Appl. No.: 09/307,294

(22) Filed: May 7, 1999

(51) Int. Cl.[7] ..... G10L 19/10; G10L 19/14
(52) U.S. Cl. ..... 704/265; 704/221; 704/214
(58) Field of Search ..... 704/265, 222, 704/221, 223, 214, 208

(56) References Cited

U.S. PATENT DOCUMENTS

| | | | | |
|---|---|---|---|---|
| 4,441,201 | * | 4/1984 | Henderson et al. | 704/265 |
| 4,821,324 | | 4/1989 | Ozawa et al. . | |
| 4,945,565 | | 7/1990 | Ozawa et al. . | |
| 5,119,424 | | 6/1992 | Asakawa et al. . | |
| 5,305,332 | * | 4/1994 | Ozawa | 714/747 |
| 5,414,796 | | 5/1995 | Jacobs et al. | 395/2.3 |
| 5,727,123 | | 3/1998 | McDonough et al. | 395/2.33 |
| 5,745,871 | * | 4/1998 | Chen | 704/207 |
| 5,884,253 | | 3/1999 | Kleijn | 704/223 |
| 5,911,128 | * | 6/1999 | DeJaco | 704/221 |
| 5,926,788 | * | 7/1999 | Nishiguchi | 704/265 |
| 6,029,133 | * | 2/2000 | Wei | 704/265 |
| 6,122,607 | * | 9/2000 | Ekudden et al. | 704/212 |

FOREIGN PATENT DOCUMENTS 1207800 8/1989 (JP) .

OTHER PUBLICATIONS

1978 Digital Processing of Speech Signals, "Linear Predictive Coding of Speech", Rabiner et al., pp. 396–453.
1992 Vector Quantization and Signal Compression, A. Gersho et al., pp. 345–393, 407–459.
1995 Speech Coding and Synthesis, "Multimode and Variable–Rate Coding of Speech", A. Das et al., pp. 257–288.

* cited by examiner

*Primary Examiner*—William R. Korzuch
*Assistant Examiner*—Abul K. Azad
(74) *Attorney, Agent, or Firm*—Philip Wadsworth; Thomas R. Rouse

(57) ABSTRACT

A multipulse interpolative coder for transition speech frames includes an extractor configured to represent a first frame of transitional speech samples by a subset of the samples of the frame. The coder also includes an interpolator configured to interpolate the subset of samples and a subset of samples extracted from an earlier-received frame to synthesize other samples of the first frame that are not included in the subset. The subset of samples is further simplified by selecting a set of pulses from the subset and assigning zero values to unselected pulses. In the alternative, a portion of the unselected pulses may be quantized. The set of pulses may be the pulses having the greatest absolute amplitudes in the subset. In the alternative, the set of pulses may be the most perceptually significant pulses of the subset.

24 Claims, 8 Drawing Sheets

MULTIPULSE INTERPOLATIVE CODING OF TRANSITION SPEECH FRAMES

BACKGROUND OF THE INVENTION

I. Field of the Invention

The present invention pertains generally to the field of speech processing, and more specifically to multipulse interpolative coding of transition speech frames.

II. Background

Transmission of voice by digital techniques has become widespread, particularly in long distance and digital radio telephone applications. This, in turn, has created interest in determining the least amount of information that can be sent over a channel while maintaining the perceived quality of the reconstructed speech. If speech is transmitted by simply sampling and digitizing, a data rate on the order of sixty-four kilobits per second (kbps) is required to achieve a speech quality of conventional analog telephone. However, through the use of speech analysis, followed by the appropriate coding, transmission, and resynthesis at the receiver, a significant reduction in the data rate can be achieved.

Devices that employ techniques to compress speech by extracting parameters that relate to a model of human speech generation are called speech coders. A speech coder divides the incoming speech signal into blocks of time, or analysis frames. Speech coders typically comprise an encoder and a decoder. The encoder analyzes the incoming speech frame to extract certain relevant parameters, and then quantizes the parameters into binary representation, i.e., to a set of bits or a binary data packet. The data packets are transmitted over the communication channel to a receiver and a decoder. The decoder processes the data packets, unquantizes them to produce the parameters, and resynthesizes the speech frames using the unquantized parameters.

The function of the speech coder is to compress the digitized speech signal into a low-bit-rate signal by removing all of the natural redundancies inherent in speech. The digital compression is achieved by representing the input speech frame with a set of parameters and employing quantization to represent the parameters with a set of bits. If the input speech frame has a number of bits $N_i$ and the data packet produced by the speech coder has a number of bits $N_o$, the compression factor achieved by the speech coder is $C_r=N_i/N_o$. The challenge is to retain high voice quality of the decoded speech while achieving the target compression factor. The performance of a speech coder depends on (1) how well the speech model, or the combination of the analysis and synthesis process described above, performs, and (2) how well the parameter quantization process is performed at the target bit rate of $N_o$ bits per frame. The goal of the speech model is thus to capture the essence of the speech signal, or the target voice quality, with a small set of parameters for each frame.

Speech coders may be implemented as time-domain coders, which attempt to capture the time-domain speech waveform by employing high time-resolution processing to encode small segments of speech (typically 5 millisecond (ms) subframes) at a time. For each subframe, a high-precision representative from a codebook space is found by means of various search algorithms known in the art. Alternatively, speech coders may be implemented as frequency-domain coders, which attempt to capture the short-term speech spectrum of the input speech frame with a set of parameters (analysis) and employ a corresponding synthesis process to recreate the speech waveform from the spectral parameters. The parameter quantizer preserves the parameters by representing them with stored representations of code vectors in accordance with known quantization techniques described in A. Gersho & R. M. Gray, *Vector Quantization and Signal Compression* (1992).

A well-known time-domain speech coder is the Code Excited Linear Predictive (CELP) coder described in L. B. Rabiner & R. W. Schafer, *Digital Processing of Speech Signals* 396–453 (1978), which is fully incorporated herein by reference. In a CELP coder, the short term correlations, or redundancies, in the speech signal are removed by a linear prediction (LP) analysis, which finds the coefficients of a short-term formant filter. Applying the short-term prediction filter to the incoming speech frame generates an LP residue signal, which is further modeled and quantized with long-term prediction filter parameters and a subsequent stochastic codebook. Thus, CELP coding divides the task of encoding the time-domain speech waveform into the separate tasks of encoding the LP short-term filter coefficients and encoding the LP residue. Time-domain coding can be performed at a fixed rate (i.e., using the same number of bits, $N_0$, for each frame) or at a variable rate (in which different bit rates are used for different types of frame contents). Variable-rate coders attempt to use only the amount of bits needed to encode the codec parameters to a level adequate to obtain a target quality. An exemplary variable rate CELP coder is described in U.S. Pat. No. 5,414,796, which is assigned to the assignee of the present invention and fully incorporated herein by reference.

Time-domain coders such as the CELP coder typically rely upon a high number of bits, $N_0$, per frame to preserve the accuracy of the time-domain speech waveform. Such coders typically deliver excellent voice quality provided the number of bits, $N_0$, per frame relatively large (e.g., 8 kbps or above). However, at low bit rates (4 kbps and below), time-domain coders fail to retain high quality and robust performance due to the limited number of available bits. At low bit rates, the limited codebook space clips the waveform-matching capability of conventional time-domain coders, which are so successfully deployed in higher-rate commercial applications.

There is presently a surge of research interest and strong commercial need to develop a high-quality speech coder operating at medium to low bit rates (i.e., in the range of 2.4 to 4 kbps and below). The application areas include wireless telephony, satellite communications, Internet telephony, various multimedia and voice-streaming applications, voice mail, and other voice storage systems. The driving forces are the need for high capacity and the demand for robust performance under packet loss situations. Various recent speech coding standardization efforts are another direct driving force propelling research and development of low-rate speech coding algorithms. A low-rate speech coder creates more channels, or users, per allowable application bandwidth, and a low-rate speech coder coupled with an additional layer of suitable channel coding can fit the overall bit-budget of coder specifications and deliver a robust performance under channel error conditions.

One effective technique to encode speech efficiently at low bit rates is multimode coding. An exemplary multimode coding technique is described in Amitava Das et al., *Multimode and Variable-Rate Coding of Speech,* in *Speech Coding and Synthesis* ch. 7 (W. B. Kleijn & K. K. Paliwal eds., 1995). Conventional multimode coders apply different modes, or encoding-decoding algorithms, to different types of input speech frames. Each mode, or encoding-decoding process, is customized to optimally represent a certain type of speech segment, such as, e.g., voiced speech, unvoiced speech, transition speech (e.g., between voiced and unvoiced), and background noise (nonspeech) in the most efficient manner. An external, open-loop mode decision mechanism examines the input speech frame and makes a decision regarding which mode to apply to the frame. The open-loop mode decision is typically performed by extracting a number of parameters from the input frame, evaluating the parameters as to certain temporal and spectral characteristics, and basing a mode decision upon the evaluation. The mode decision is thus made without knowing in advance the exact condition of the output speech, i.e., how close the output speech will be to the input speech in terms of voice quality or other performance measures.

To retain high voice quality, it is critical to represent transition speech frames accurately. For a low-bit-rate speech coder that uses a limited number of bits per frame, this has traditionally proven to be difficult. Thus, there is a need for a speech coder that accurately represents transition speech frames coded at a low bit rate.

SUMMARY OF THE INVENTION

The present invention is directed to a speech coder that accurately represents transition speech frames coded at a low bit rate. Accordingly, in one aspect of the invention, a method of coding transitional speech frames advantageously includes the steps of representing a first frame of transitional speech samples by a first subset of the samples of the first frame; and interpolating the first subset of samples and a second subset of samples extracted from a second, earlier-received frame of transitional speech samples to synthesize other samples of the first frame that are not included in the first subset.

In another aspect of the invention, a speech coder for coding transitional speech frames advantageously includes means for representing a first frame of transitional speech samples by a first subset of the samples of the first frame; and means for interpolating the first subset of samples and a second subset of samples extracted from a second, earlier-received frame of transitional speech samples to synthesize other samples of the first frame that are not included in the first subset.

In another aspect of the invention, a speech coder for coding transitional frames of speech advantageously includes an extractor configured to represent a first frame of transitional speech samples by a first subset of the samples of the first frame; and an interpolator coupled to the extractor and configured to interpolate the first subset of samples and a second subset of samples extracted from a second, earlier-received frame of transitional speech samples to synthesize other samples of the first frame that are not included in the first subset.

DETAILED DESCRIPTION OF THE PREFERRED EMBODIMENTS

Figure 1:
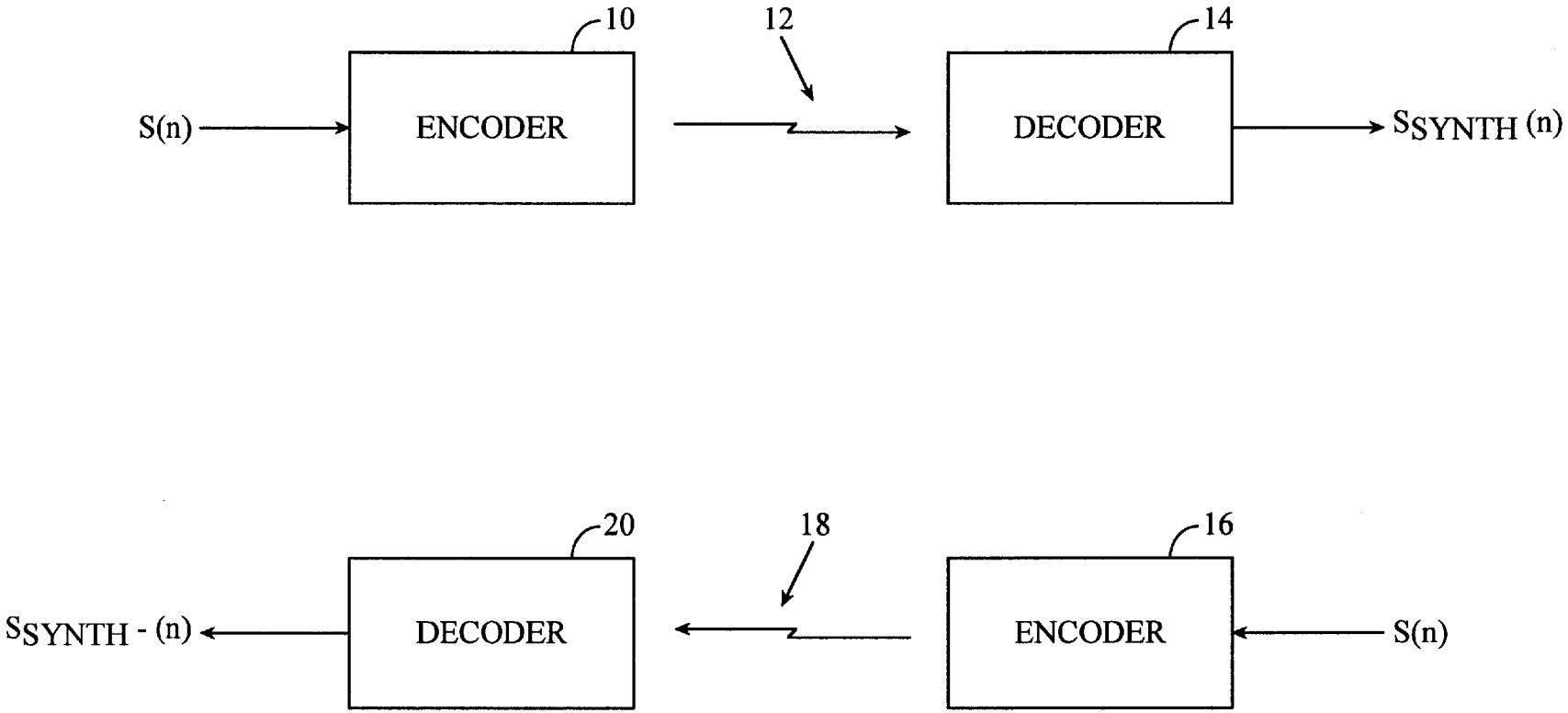
FIG. 1 is a block diagram of a communication channel terminated at each end by speech coders.

In FIG. 1 a first encoder 10 receives digitized speech samples s(n) and encodes the samples s(n) for transmission on a transmission medium 12, or communication channel 12, to a first decoder 14. The decoder 14 decodes the encoded speech samples and synthesizes an output speech signal $s_{SYNTH}(n)$. For transmission in the opposite direction, a second encoder 16 encodes digitized speech samples s(n), which are transmitted on a communication channel 18. A second decoder 20 receives and decodes the encoded speech samples, generating a synthesized output speech signal $s_{SYNTH}(n)$.

The speech samples s(n) represent speech signals that have been digitized and quantized in accordance with any of various methods known in the art including, e.g., pulse code modulation (PCM), companded $\mu$-law, or A-law. As known in the art, the speech samples s(n) are organized into frames of input data wherein each frame comprises a predetermined number of digitized speech samples s(n). In an exemplary embodiment, a sampling rate of 8 kHz is employed, with each 20 ms frame comprising 160 samples. In the embodiments described below, the rate of data transmission may advantageously be varied on a frame-to-frame basis from 13.2 kbps (full rate) to 6.2 kbps (half rate) to 2.6 kbps (quarter rate) to 1 kbps (eighth rate). Varying the data transmission rate is advantageous because lower bit rates may be selectively employed for frames containing relatively less speech information. As understood by those skilled in the art, other sampling rates, frame sizes, and data transmission rates may be used.

The first encoder 10 and the second decoder 20 together comprise a first speech coder, or speech codec. Similarly, the second encoder 16 and the first decoder 14 together comprise a second speech coder. It is understood by those of skill in the art that speech coders may be implemented with a digital signal processor (DSP), an application-specific integrated circuit (ASIC), discrete gate logic, firmware, or any conventional programmable software module and a microprocessor. The software module could reside in RAM memory, flash memory, registers, or any other form of writable storage medium known in the art. Alternatively, any conventional processor, controller, or state machine could be substituted for the microprocessor. Exemplary ASICs designed specifically for speech coding are described in U.S. Pat. No. 5,727,123, assigned to the assignee of the present invention and fully incorporated herein by reference, and U.S. application Ser. No. 08/197,417, entitled VOCODER ASIC, filed Feb. 16, 1994, assigned to the assignee of the present invention, and fully incorporated herein by reference.

Figure 2:
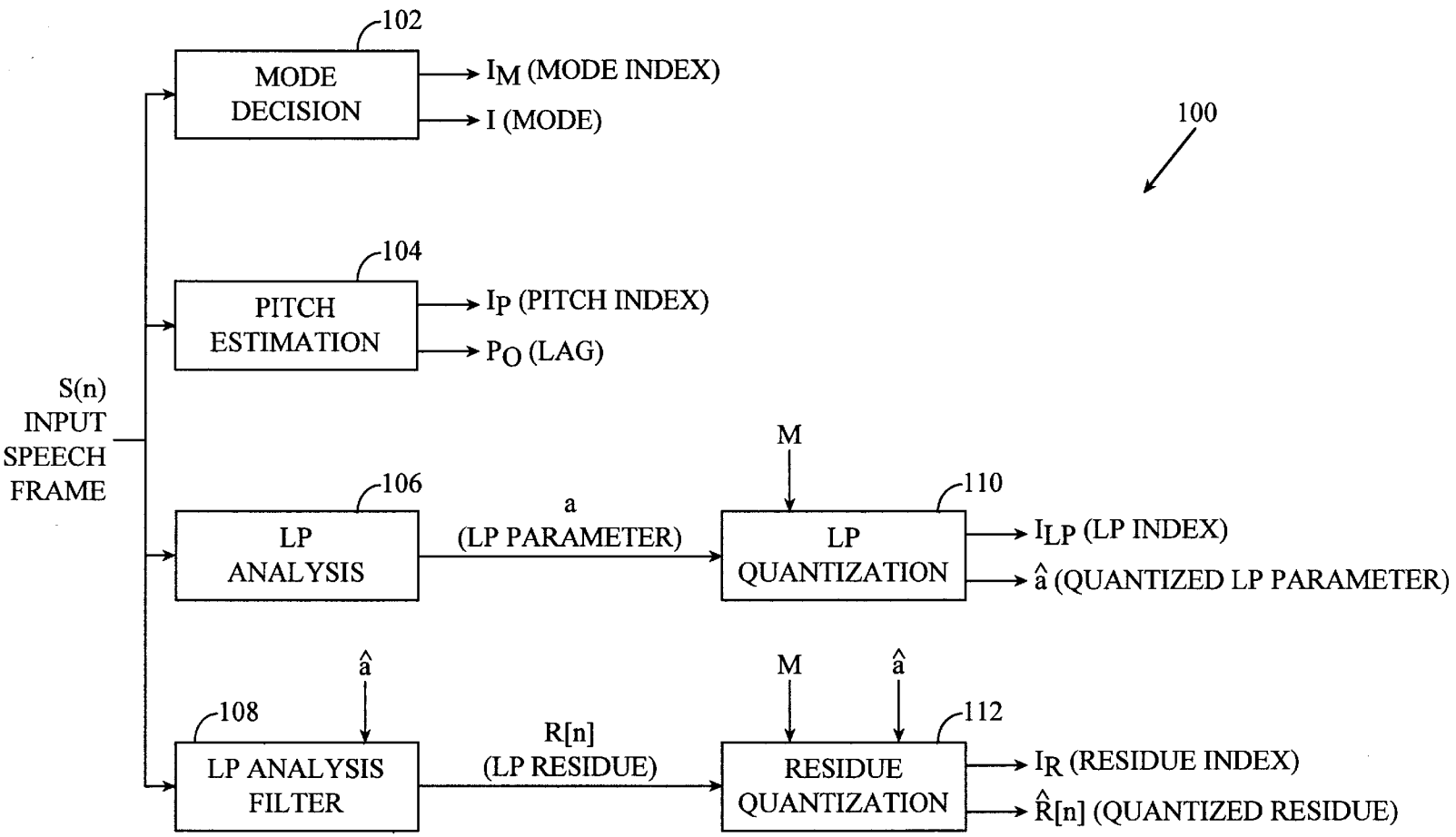
FIG. 2 is a block diagram of an encoder.

In FIG. 2 an encoder 100 that may be used in a speech coder includes a mode decision module 102, a pitch estimation module 104, an LP analysis module 106, an LP analysis filter 108, an LP quantization module 110, and a residue quantization module 112. Input speech frames s(n) are provided to the mode decision module 102, the pitch estimation module 104, the LP analysis module 106, and the LP analysis filter 108. The mode decision module 102 produces a mode index $I_M$ and a mode M based upon the periodicity of each input speech frame s(n). Various methods of classifying speech frames according to periodicity are described in U.S. application Ser. No. 08/815,354, entitled METHOD AND APPARATUS FOR PERFORMING REDUCED RATE VARIABLE RATE VOCODING, filed Mar. 11, 1997, assigned to the assignee of the present invention, and fully incorporated herein by reference. Such methods are also incorporated into the Telecommunication Industry Association Industry Interim Standards TIA/EIA IS-127 and TIA/EIA IS-733.

The pitch estimation module 104 produces a pitch index $I_P$ and a lag value $P_0$ based upon each input speech frame s(n). The LP analysis module 106 performs linear predictive analysis on each input speech frame s(n) to generate an LP parameter a. The LP parameter a is provided to the LP quantization module 110. The LP quantization module 110 also receives the mode M, thereby performing the quantization process in a mode-dependent manner. The LP quantization module 110 produces an LP index $I_{LP}$ and a quantized LP parameter â. The LP analysis filter 108 receives the quantized LP parameter â in addition to the input speech frame s(n). The LP analysis filter 108 generates an LP residue signal R[n], which represents the error between the input speech frames s(n) and the reconstructed speech based on the quantized linear predicted parameters â. The LP residue R[n], the mode M, and the quantized LP parameter â are provided to the residue quantization module 112. Based upon these values, the residue quantization module 112 produces a residue index $I_R$ and a quantized residue signal R̂[n].

Figure 3:
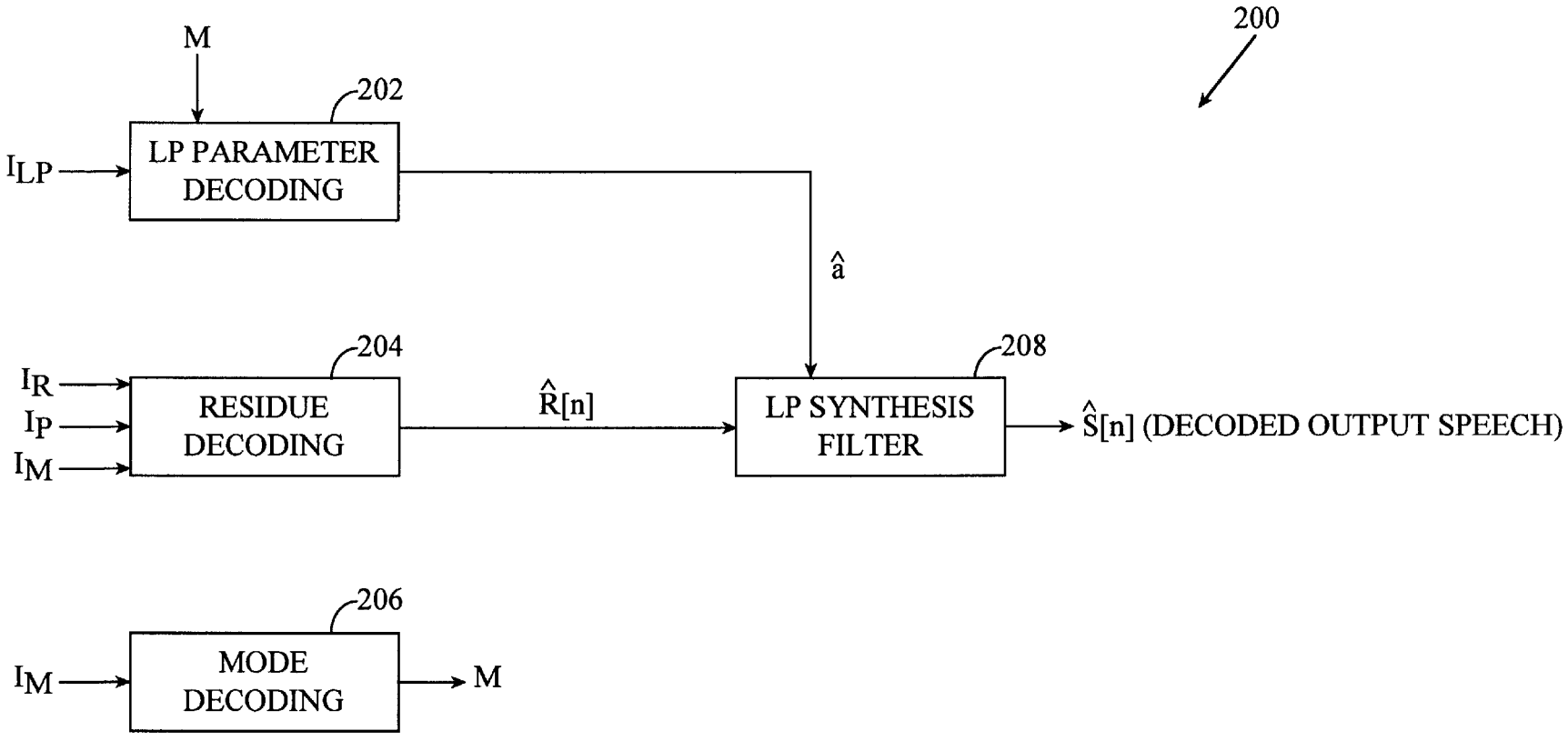
FIG. 3 is a block diagram of a decoder.

In FIG. 3 a decoder 200 that may be used in a speech coder includes an LP parameter decoding module 202, a residue decoding module 204, a mode decoding module 206, and an LP synthesis filter 208. The mode decoding module 206 receives and decodes a mode index $I_M$, generating therefrom a mode M. The LP parameter decoding module 202 receives the mode M and an LP index $I_{LP}$. The LP parameter decoding module 202 decodes the received values to produce a quantized LP parameter â. The residue decoding module 204 receives a residue index $I_R$, a pitch index $I_P$, and the mode index $I_M$. The residue decoding module 204 decodes the received values to generate a quantized residue signal R̂[n]. The quantized residue signal R̂[n] and the quantized LP parameter â are provided to the LP synthesis filter 208, which synthesizes a decoded output speech signal ŝ[n] therefrom.

Operation and implementation of the various modules of the encoder 100 of FIG. 2 and the decoder 200 of FIG. 3 are known in the art and described in the aforementioned U.S. Pat. No. 5,414,796 and L. B. Rabiner & R. W. Schafer, *Digital Processing of Speech Signals* 396–453 (1978).

Figure 4:
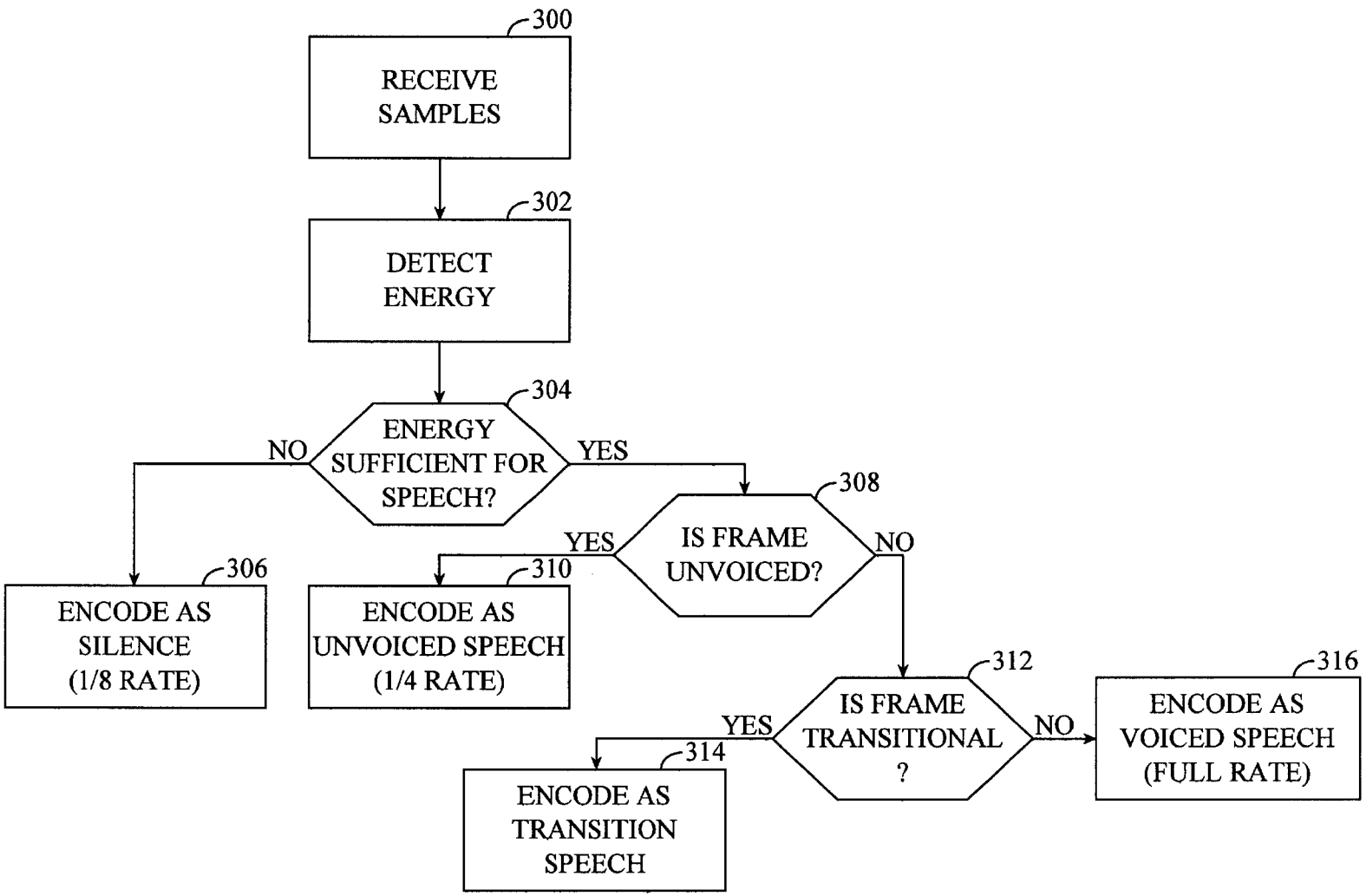
FIG. 4 is a flow chart illustrating a speech coding decision process.

As illustrated in the flow chart of FIG. 4, a speech coder in accordance with one embodiment follows a set of steps in processing speech samples for transmission. In step 300 the speech coder receives digital samples of a speech signal in successive frames. Upon receiving a given frame, the speech coder proceeds to step 302. In step 302 the speech coder detects the energy of the frame. The energy is a measure of the speech activity of the frame. Speech detection is performed by summing the squares of the amplitudes of the digitized speech samples and comparing the resultant energy against a threshold value. In one embodiment the threshold value adapts based on the changing level of background noise. An exemplary variable threshold speech activity detector is described in the aforementioned U.S. Pat. No. 5,414,796. Some unvoiced speech sounds can be extremely low-energy samples that may be mistakenly encoded as background noise. To prevent this from occurring, the spectral tilt of low-energy samples may be used to distinguish the unvoiced speech from background noise, as described in the aforementioned U.S. Pat. No. 5,414,796.

After detecting the energy of the frame, the speech coder proceeds to step 304. In step 304 the speech coder determines whether the detected frame energy is sufficient to classify the frame as containing speech information. If the detected frame energy falls below a predefined threshold level, the speech coder proceeds to step 306. In step 306 the speech coder encodes the frame as background noise (i.e., nonspeech, or silence). In one embodiment the background noise frame is encoded at ⅛ rate, or 1 kbps. If in step 304 the detected frame energy meets or exceeds the predefined threshold level, the frame is classified as speech and the speech coder proceeds to step 308.

In step 308 the speech coder determines whether the frame is unvoiced speech, i.e., the speech coder examines the periodicity of the frame. Various known methods of periodicity determination include, e.g., the use of zero crossings and the use of normalized autocorrelation functions (NACFs). In particular, using zero crossings and NACFs to detect periodicity is described in U.S. application Ser. No. 08/815,354, entitled METHOD AND APPARATUS FOR PERFORMING REDUCED RATE VARIABLE RATE VOCODING, filed Mar. 11, 1997, assigned to the assignee of the present invention, and fully incorporated herein by reference. In addition, the above methods used to distinguish voiced speech from unvoiced speech are incorporated into the Telecommunication Industry Association Interim Standards TIA/EIA IS-127 and TIA/EIA IS-733. If the frame is determined to be unvoiced speech in step 308, the speech coder proceeds to step 310. In step 310 the speech coder encodes the frame as unvoiced speech. In one embodiment unvoiced speech frames are encoded at quarter rate, or 2.6 kbps. If in step 308 the frame is not determined to be unvoiced speech, the speech coder proceeds to step 312.

In step 312 the speech coder determines whether the frame is transitional speech, using periodicity detection methods that are known in the art, as described in, e.g., the aforementioned U.S. application Ser. No. 08/815,354. If the frame is determined to be transitional speech, the speech coder proceeds to step 314. In step 314 the frame is encoded as transition speech (i.e., transition from unvoiced speech to voiced speech). In one embodiment the transition speech frame is encoded in accordance with a multipulse interpolative coding method described below with reference to FIG. 6.

If in step 312 the speech coder determines that the frame is not transitional speech, the speech coder proceeds to step 316. In step 316 the speech coder encodes the frame as voiced speech. In one embodiment voiced speech frames may be encoded at full rate, or 13.2 kbps.

Figure 5A:
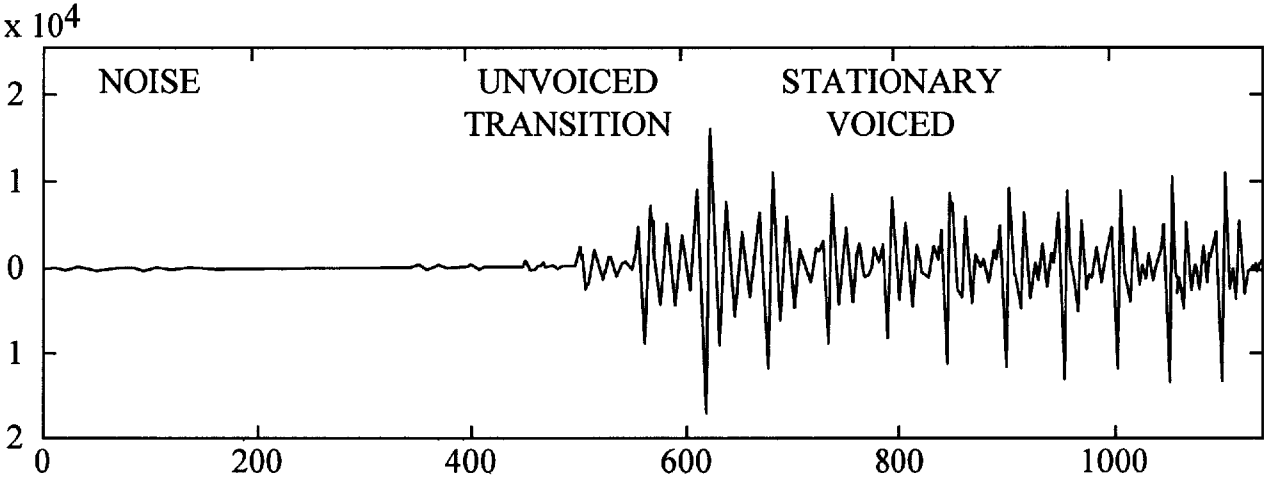
FIG. 5A is a graph speech signal amplitude versus time.
Figure 5B:
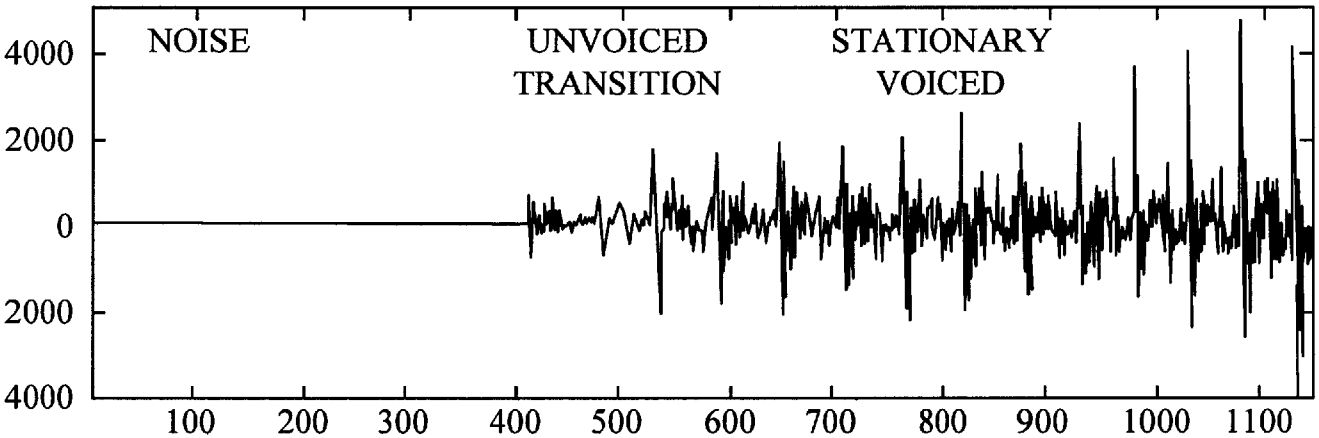
FIG. 5B is a graph of linear prediction (LP) residue amplitude versus time.

Those of skill would appreciate that either the speech signal or the corresponding LP residue may be encoded by following the steps shown in FIG. 4. The waveform characteristics of noise, unvoiced, transition, and voiced speech can be seen as a function of time in the graph of FIG. 5A. The waveform characteristics of noise, unvoiced, transition, and voiced LP residue can be seen as a function of time in the graph of FIG. 5B.

Figure 6:
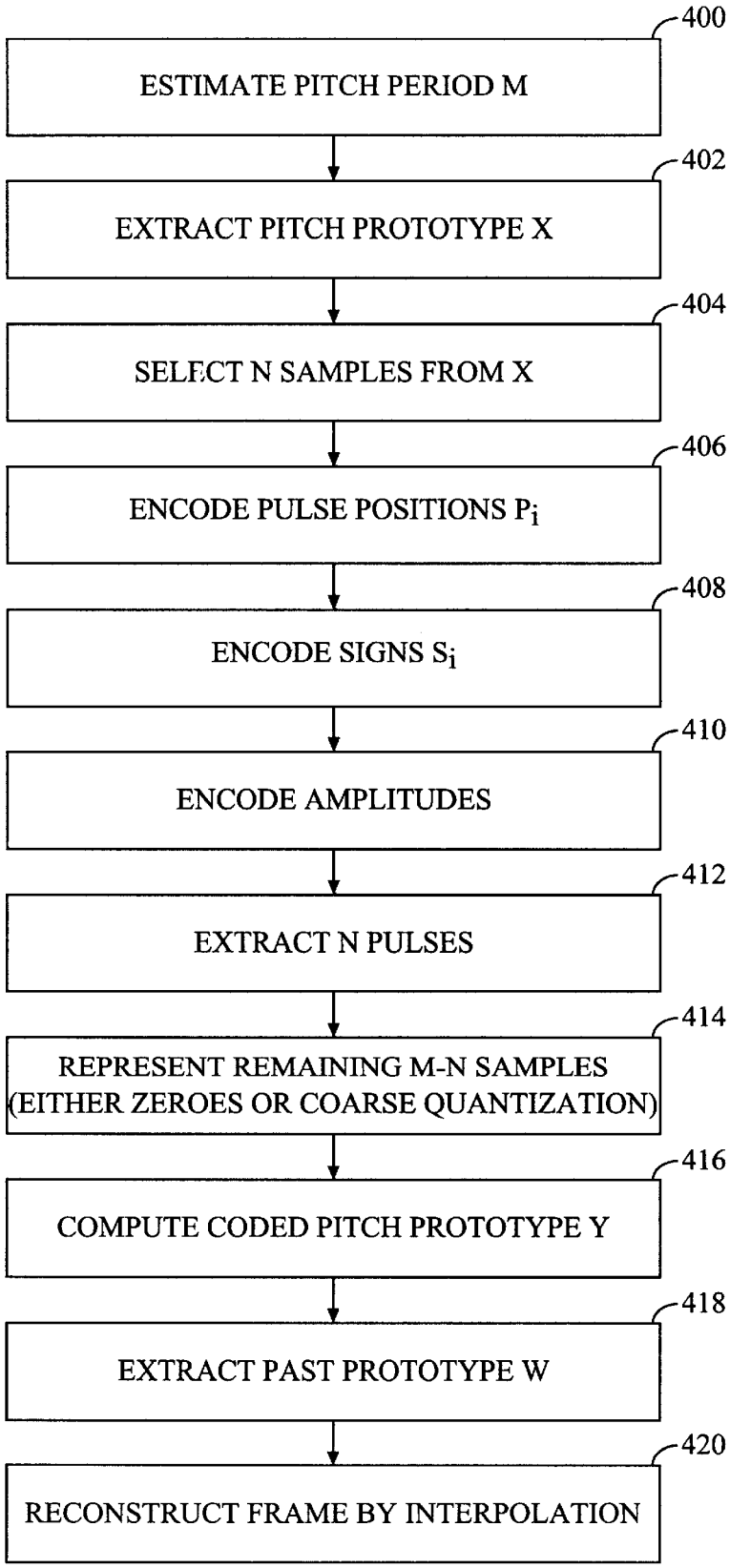
FIG. 6 is a flow chart illustrating a multipulse interpolative coding process for transition speech frames.

In one embodiment a speech coder uses a multipulse interpolative coding algorithm to code transition speech frames in accordance with the method steps illustrated in the flow chart of FIG. 6. In step 400 the speech coder estimates the pitch period M of the current K sample LP speech residue frame S[n], where n=1,2, . . . ,K, and the immediate future neighborhood of the frame S[n]. In one embodiment the LP speech residue frame S[n] comprises 160 samples (i.e., K=160). The pitch period M is a fundamental period that repeats within a given frame. The speech coder then proceeds to step 402. In step 402 the speech coder extracts a pitch prototype X having the last M samples of the current residue frame. The pitch prototype X may advantageously be the final pitch period (M samples) of the frame S[n]. In the alternative, the pitch prototype X may be any pitch period M of the frame S[n]. The speech coder then proceeds to step 404.

In step 404 the speech coder selects N important samples, or pulses, having amplitudes Qi and signs Si, where i=1,2, . . . ,N, from positions Pi from the M-sample, pitch prototype X. Thus, N "best" samples have been selected from the M-sample pitch prototype X, and M-N unselected samples remain in the pitch prototype X. The speech coder then proceeds to step 406. In step 406 the speech coder encodes the positions of the pulses with Bp bits. The speech coder then proceeds to step 408. In step 408 the speech coder encodes the signs of the pulses with Bs bits. The speech coder then proceeds to step 410. In step 410 the speech coder encodes the amplitudes of the pulses with Ba bits. The quantized values of the N pulse amplitudes Qi are denoted Zi, for i=1,2, . . . ,N. The speech coder then proceeds to step 412.

In step 412 the speech coder extracts the pulses. In one embodiment the pulse extraction step is performed by ordering all of the M pulses according to absolute (i.e., unsigned) amplitude, and then choosing the N highest pulses (i.e., the N pulses having the greatest absolute amplitudes). In an alternate embodiment the pulse extraction step selects the N "best" pulses from the standpoint of perceptual importance, in accordance with the following description.

Figure 7:
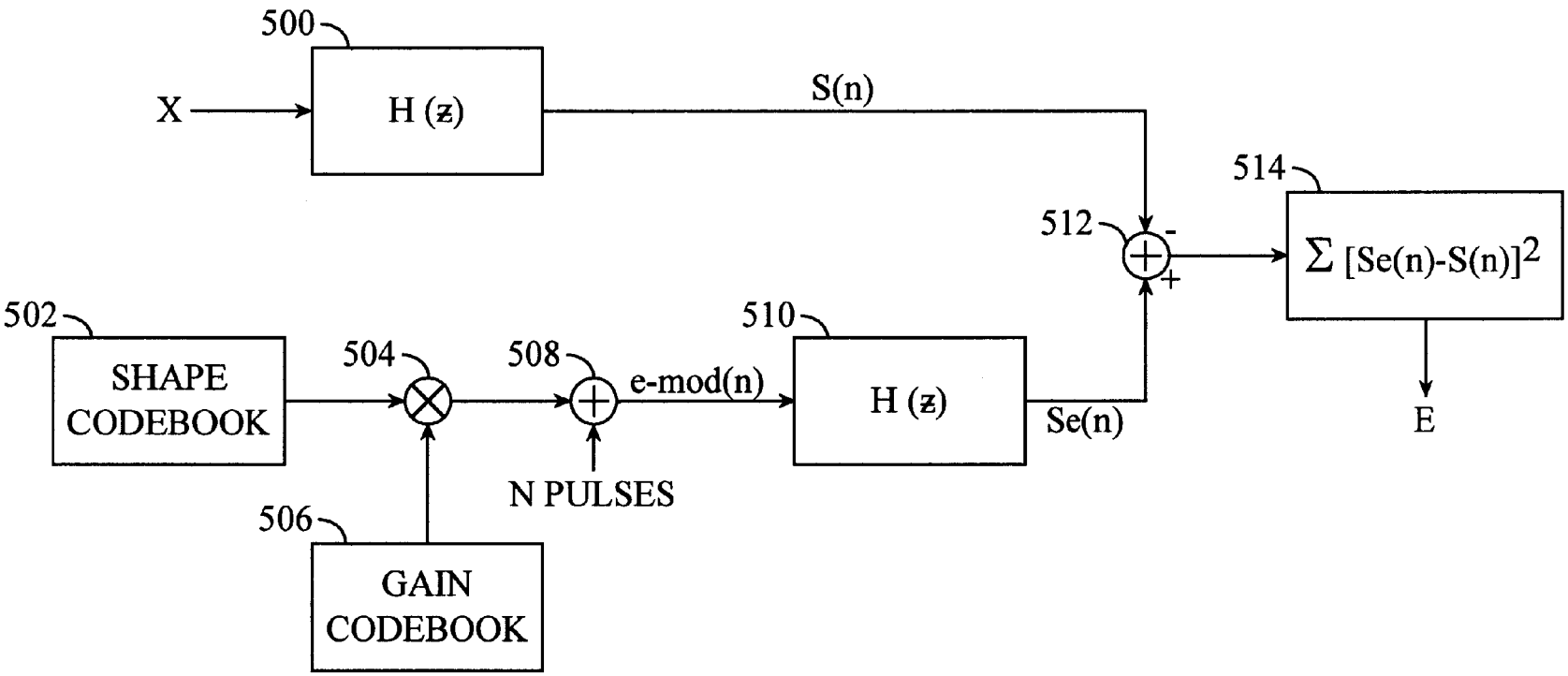
FIG. 7 is a block diagram of a system for filtering an LP-residue-domain signal to generate a speech domain signal, or for inverse filtering a speech-domain signal to generate an LP-residue-domain signal.
Figure 8A:
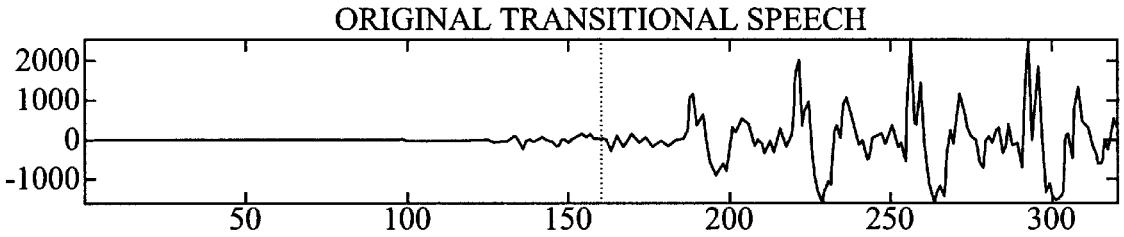
FIGS. 8A–D are graphs of signal amplitude versus time for, respectively, original transitional speech, uncoded residual, coded/quantized residual, and decoded/reconstructed speech.
Figure 8B:
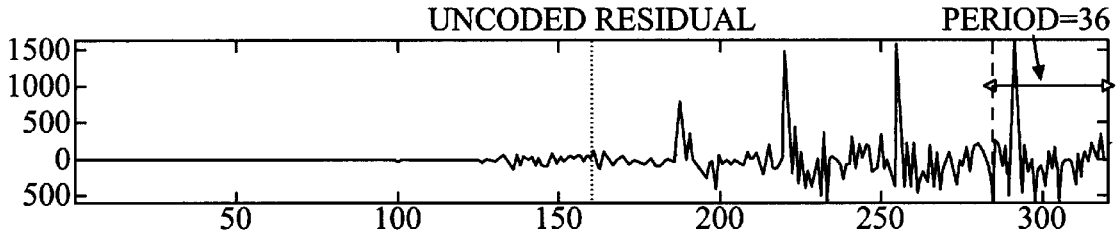
Figure 8C:
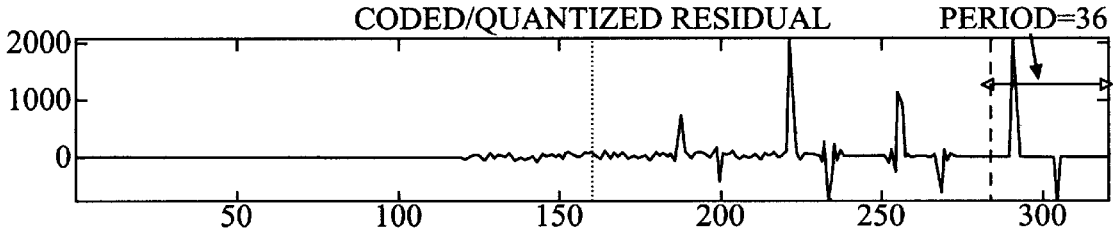
Figure 8D:
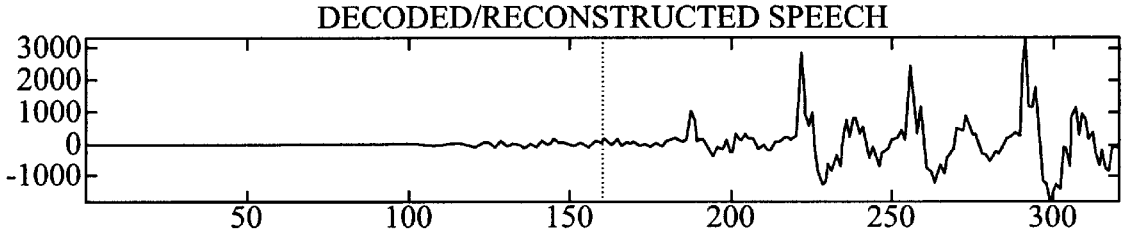

As illustrated in FIG. 7, a speech signal may be converted from the LP residue domain to the speech domain by filtering. Conversely, the speech signal may be converted from the speech domain to the LP residue domain by inverse filtering. In accordance with one embodiment, as shown in FIG. 7, a pitch prototype X is input to a first LP synthesis filter 500, denoted H(z). The first LP synthesis filter 500 produces a perceptually weighted speech-domain version of the pitch prototype X, denoted S(n). A shape codebook 502 produces shape vector values, which are provided to a multiplier 504. A gain codebook 506 produces gain vector values, which are also provided to the multiplier 504. The multiplier 504 multiplies the shape vector values with the gain vector values, producing shape-gain product values. The shape-gain product values are provided to a first adder 508. A number, N, of pulses (the number N, as described below, is the number of samples that minimizes the shape-gain error, E, between the pitch prototype X and a model prototype e_mod[n]) is also provided to the first adder 508. The first adder 508 adds the N pulses to the shape-gain product values, producing a model prototype e_mod[n]. The model prototype e_mod[n] is provided to a second LP synthesis filter 510, also denoted H(z). The second LP synthesis filter 510 produces a perceptually weighted speech-domain version of the model prototype e_mod[n], denoted Se(n). The speech-domain values S(n) and Se(n) are provided to a second adder 512. The second adder 512 subtracts S(n) from Se(n), providing difference values to a sum-of-squares calculator 514. The sum-of-squares calculator 514 computes the squares of the difference values, producing an energy, or error, value E.

In accordance with the alternate embodiment mentioned above with reference to FIG. 6, the impulse response for an LP synthesis filter H(z) (not shown), or a perceptually weighted LP synthesis filter H(z/α), for the current transition speech frame is denoted H(n). The model of the pitch prototype X is denoted e_mod[n]. A perceptually weighted speech domain error E may be defined in accordance with the following equation:

$$E = \sum_{n=1}^{M} (Se(n) - S(n))^2$$

where $$Se(n)=H(n)*e_mod(n),$$

and $$S(n)=H(n)*X,$$

where "*" denotes a suitable filtering or convolution operation, as known in the art, and Se(n) and S(n) denote perceptually weighted speech domain versions of the pitch prototypes e_mod[n] and X, respectively. In the alternate embodiment described, the N best samples may be selected to form e_mod[n] from the M samples of the pitch prototype X as follows: The N samples, which may be denoted the j-th set out of a possible ${}^{M}C_{N}$ combinations, are advantageously chosen to create the model $e_mod_j(n)$ such that the error $E_j$ is minimized for all j belonging to j=1,2,3 . . . ,${}^{M}C_{N}$, where $E_j$ is defined in accordance with the following equations:

$$E_j = \sum_{n=1}^{M} (Se_j(n) - S(n))^2$$

and $$Sej(n)=H(n)*e_modj[n].$$

After extracting the pulses, the speech coder proceeds to step 414. In step 414 the remaining M-N samples of the pitch prototype X are represented in accordance with one of two possible methods associated with alternate embodiments. In one embodiment the remaining M-N samples of the pitch prototype X may be selected by replacing the M-N samples with zero values. In an alternate embodiment, the remaining M-N samples of the pitch prototype X may be selected by replacing the M-N samples with a shape vector using a codebook with Rs bits and a gain using a codebook with Rg bits. Accordingly, a gain g and a shape vector H represent the M-N samples. The gain g and the shape vector H have component values $g_j$ and $H_k$ chosen from the codebooks by minimizing the distortion $E_{jk}$. The distortion $E_{jk}$ is given by the following equations:

$$E_{jk} = \sum_{n=1}^{M} (Se_{jk}(n) - S(n))^2$$

and $$Se_{jk}(n)=H(n)*e_mod_{jk}[n],$$

where the model prototype $e_mod_{jk}[n]$ is formed with the M pulses described above and M-N samples represented by the j-th gain codeword $g_j$ and the k-th shape code-word $H_k$. The selection may thus advantageously be performed in a jointly optimized way by selecting the combination {j,k} that delivers the minimal value of $E_{jk}$. The speech coder then proceeds to step 416.

In step 416 the coded pitch prototype Y is computed. The coded pitch prototype Y models the original pitch prototype X by placing the N pulses back in the positions Pi, replacing the amplitudes Qi with Si*Zi, and replacing the remaining M-N samples with either zeros (in one embodiment) or the samples from the chosen gain-shape representation, g*H, as described above (in an alternate embodiment). The coded pitch prototype Y corresponds to the sum of the reconstructed, or synthesized, N "best" samples plus the reconstructed, or synthesized, remaining M-N samples. The speech coder then proceeds to step 418.

In step 418 the speech coder extracts an M-sample "past prototype" W from the past (i.e., immediately preceding) decoded residue frame. The past prototype W is extracted by taking the last M samples from the past decoded residue frame. Alternatively, the past prototype W could be constructed from another set of M samples of the past frame, provided the pitch prototype X was taken from a corresponding set of M samples of the current frame. The speech coder then proceeds to step 420.

In step 420 the speech coder reconstructs the entire K samples of the decoded current frame of residue $S_{SYNTH}[n]$. The reconstruction is advantageously accomplished with any conventional interpolation method in which the last M samples are formed with the reconstructed pitch prototype Y, and the first K-M samples are formed by interpolating the past prototype W and the current coded pitch prototype Y. In one embodiment the interpolation may be performed in accordance with the following steps:

W and Y are first advantageously aligned to derive the optimal relative positioning and the average pitch period to be used for interpolation. The alignment A* is obtained as the rotation of the current pitch prototype Y that corresponds to the maximum cross-correlation of the rotated Y with W. The cross-correlations C[A] at each possible alignment A, taking values from 0 to M−1 or a subset of the range 0 to M−1, may in turn be computed in accordance with the following equation:

$$C[A] = \sum_{n=0}^{M-1} Y[(n+A)\,\%\,M]W$$

The average pitch period Lav is then computed in accordance with the following equation:

$$Lav=(160-M)M/(MNp-A^*),$$

where $$Np=\text{round}\{A^*/M+(160-M)/M\}.$$

An interpolation is performed to compute the first K-M samples in accordance with the following equation:

$$S_{SYNTH}=\{(160-n-M)W[(n\alpha)\%M]+nY[(n\alpha+A^*)\%M]\}/(160-M),$$

where $\alpha$=M/Lav, and the sample at non-integral values for the indices n' (which are equal to either n$\alpha$ or n$\alpha$+A*) are computed using a conventional interpolation method depending upon the desired accuracy in the fractional value of n'. The round operation and the modulo operation (denoted by the % symbol) in the above equations are well known in the art. Graphs of original transitional speech, uncoded residue, coded/quantized residue, and decoded/reconstructed speech with respect to time are depicted in, respectively, FIGS. 8A–D.

In one embodiment the encoded transition residue frame may be computed in accordance with a dosed-loop technique. Accordingly, the encoded transition residue frame is computed, as described above. Then the perceptual signal-to-noise ratio (PSNR) is computed for the entire frame. If the PSNR rises above a predefined threshold value, then a suitable high-rate, high-precision, waveform coding method such as CELP may be used to encode the frame. Such a technique is described in U.S. application Ser. No. 09/259,151, filed Feb. 26, 1999, entitled CLOSED-LOOP MULTI-MODE MIXED-DOMAIN LINEAR PREDICTION (MDLP) SPEECH CODER, and assigned to the assignee of the present invention. By using the low-bit-rate speech coding method described above when possible, and substituting a high-rate CELP speech coding method when the low-bit-rate speech coding method fails to deliver a target value of the distortion measure, transition speech frames can be coded with a relatively high quality (as determined by the threshold value or the distortion measure used) while using a low average coding rate.

Thus, a novel multipulse interpolative coder for transition speech frames has been described. Those of skill in the art would understand that the various illustrative logical blocks and algorithm steps described in connection with the embodiments disclosed herein may be implemented or performed with a digital signal processor (DSP), an application specific integrated circuit (ASIC), discrete gate or transistor logic, discrete hardware components such as, e.g., registers and FIFO, a processor executing a set of firmware instructions, or any conventional programmable software module and a processor. The processor may advantageously be a microprocessor, but in the alternative, the processor may be any conventional processor, controller, microcontroller, or state machine. The software module could reside in RAM memory, flash memory, registers, or any other form of writable storage medium known in the art. Those of skill would further appreciate that the data, instructions, commands, information, signals, bits, symbols, and chips that may be referenced throughout the above description are advantageously represented by voltages, currents, electromagnetic waves, magnetic fields or particles, optical fields or particles, or any combination thereof.

Preferred embodiments of the present invention have thus been shown and described. It would be apparent to one of ordinary skill in the art, however, that numerous alterations may be made to the embodiments herein disclosed without departing from the spirit or scope of the invention. Therefore, the present invention is not to be limited except in accordance with the following claims.

What is claimed is:

1. A method of coding transitional speech frames, comprising the steps of:

representing a first frame of transitional speech samples by a first subset of the samples of the first frame; and interpolating the first subset of samples and a second subset of samples extracted from a second, earlier-received frame of transitional speech samples to synthesize other samples of the first frame that are not included in the first subset.

2. The method of claim 1, further comprising the steps of transmitting the first subset of samples after performing the representing step, and receiving the first subset of samples before performing the interpolating step.

3. The method of claim 1, further comprising the step of simplifying the first subset of samples.

4. The method of claim 3, wherein the simplifying step comprises the steps of selecting perceptually significant samples from the first subset of samples, and assigning a zero value to all unselected samples.

5. The method of claim 4, wherein the perceptually significant samples are samples selected to minimize perceptually weighted speech-domain error between the first frame of transitional speech samples and a synthesized first frame of transitional speech samples.

6. The method of claim 3, wherein the simplifying step comprises the steps of selecting samples with relatively high absolute amplitudes from the first subset of samples, and assigning a zero value to all unselected samples.

7. The method of claim 3, wherein the simplifying step comprises the steps of selecting perceptually significant samples from the first subset of samples, and quantizing a portion of all unselected samples.

8. The method of claim 7, wherein the perceptually significant samples are samples selected to minimize gain and shape error between the first frame of transitional speech samples and a synthesized first frame of transitional speech samples.

9. The method of claim 3, wherein the simplifying step comprises the steps of selecting samples with relatively high absolute amplitudes from the first subset of samples, and quantizing a portion of all unselected samples.

10. A speech coder for coding transitional speech frames, comprising:

means for representing a first frame of transitional speech samples by a first subset of the samples of the first frame; and means for interpolating the first subset of samples and a second subset of samples extracted from a second, earlier-received frame of transitional speech samples to synthesize other samples of the first frame that are not included in the first subset.

11. The speech coder of claim 10, further comprising means for simplifying the first subset of samples.

12. The speech coder of claim 11, wherein the means for simplifying comprises means for selecting perceptually significant samples from the first subset of samples, and means for assigning a zero value to all unselected samples.

13. The speech coder of claim 12, wherein the perceptually significant samples are samples selected to minimize perceptually weighted speech-domain error between the first frame of transitional speech samples and a synthesized first frame of transitional speech samples.

14. The speech coder of claim 11, wherein the means for simplifying comprises means for selecting samples with relatively high absolute amplitudes from the first subset of samples, and means for assigning a zero value to all unselected samples.

15. The speech coder of claim 11, wherein the means for simplifying comprises means for selecting perceptually significant samples from the first subset of samples, and means for quantizing a portion of all unselected samples.

16. The speech coder of claim 15, wherein the perceptually significant samples are samples selected to minimize gain and shape error between the first frame of transitional speech samples and a synthesized first frame of transitional speech samples.

17. The speech coder of claim 11, wherein the means for simplifying comprises means for selecting samples with relatively high absolute amplitudes from the first subset of samples, and means for quantizing a portion of all unselected samples.

18. A speech coder for coding transitional speech frames, comprising:

an extractor configured to represent a first frame of transitional speech samples by a first subset of the samples of the first frame; and an interpolator coupled to the extractor and configured to interpolate the first subset of samples and a second subset of samples extracted from a second, earlier-received frame of transitional speech samples to synthesize other samples of the first frame that are not included in the first subset.

19. The speech coder of claim 18, further comprising a pulse selector configured to select perceptually significant samples from the first subset of samples, wherein a zero value is assigned to all unselected samples.

20. The speech coder of claim 19, wherein the perceptually significant samples are samples selected to minimize perceptually weighted speech-domain error between the first frame of transitional speech samples and a synthesized first frame of transitional speech samples.

21. The speech coder of claim 18, further comprising a pulse selector configured to select samples with relatively high absolute amplitudes from the first subset of samples, wherein a zero value is assigned to all unselected samples.

22. The speech coder of claim 18, further comprising a pulse selector configured to select perceptually significant samples from the first subset of samples, wherein a portion of all unselected samples is quantized.

23. The speech coder of claim 22, wherein the perceptually significant samples are samples selected to minimize gain and shape error between the first frame of transitional speech samples and a synthesized first frame of transitional speech samples.

24. The speech coder of claim 18, further comprising a pulse selector configured to select samples with relatively high absolute amplitudes from the first subset of samples, wherein a portion of all unselected samples is quantized.

* * * * *